US007166067B2

(12) United States Patent
Talish et al.

(10) Patent No.: US 7,166,067 B2
(45) Date of Patent: Jan. 23, 2007

(54) EXERCISE EQUIPMENT UTILIZING MECHANICAL VIBRATIONAL APPARATUS

(75) Inventors: Roger J. Talish, Hillsborough, NJ (US); Kenneth J. McLeod, Vestal, NY (US); Clinton T. Rubin, Port Jefferson, NY (US)

(73) Assignee: Juvent, Inc., Somerset, NJ (US)

( * ) Notice: Subject to any disclaimer, the term of this patent is extended or adjusted under 35 U.S.C. 154(b) by 358 days.

(21) Appl. No.: 10/265,785

(22) Filed: Oct. 7, 2002

(65) Prior Publication Data

US 2004/0067833 A1 Apr. 8, 2004

(51) Int. Cl.
*A63B 71/00* (2006.01)

(52) U.S. Cl. ..... 482/148; 482/95

(58) Field of Classification Search ..... 482/146–147, 482/34, 148; 601/23, 51, 49
See application file for complete search history.

(56) References Cited

U.S. PATENT DOCUMENTS

| | | | | |
|---|---|---|---|---|
| 3,767,195 | A | 10/1973 | Dimick | |
| 4,358,105 | A | 11/1982 | Sweeney, Jr. | |
| 4,570,927 | A | 2/1986 | Petrofsky et al. | |
| 4,687,195 | A | 8/1987 | Potts | |
| 4,917,376 | A | 4/1990 | Lo | |
| 4,928,959 | A | 5/1990 | Bassett et al. | |
| 5,000,442 | A | 3/1991 | Dalebout et al. | |
| 5,103,806 | A | 4/1992 | McLeod et al. | |
| 5,191,880 | A | 3/1993 | McLeod et al. | |
| 5,273,028 | A | 12/1993 | McLeod et al. | |
| 5,295,931 | A | 3/1994 | Dreibelbis et al. | |
| 5,368,044 | A | 11/1994 | Cain et al. | |
| 5,376,065 | A * | 12/1994 | McLeod et al. | 601/98 |
| 5,380,269 | A | 1/1995 | Urso | |
| RE34,959 | E * | 5/1995 | Potts | 482/52 |
| 5,431,612 | A | 7/1995 | Holden | |
| 5,484,388 | A | 1/1996 | Bassett et al. | |
| 5,492,525 | A | 2/1996 | Gibney | |
| 5,779,600 | A | 7/1998 | Pape | |
| 5,868,649 | A | 2/1999 | Erickson et al. | |
| 5,868,654 | A * | 2/1999 | Norian | 482/140 |
| 5,957,814 | A | 9/1999 | Eschenbach | |
| 6,019,710 | A | 2/2000 | Dalebout et al. | |
| 6,080,088 | A * | 6/2000 | Petersen et al. | 482/72 |
| 6,086,078 | A | 7/2000 | Ferez | |
| 6,093,135 | A | 7/2000 | Huang | |
| 6,234,975 | B1 | 5/2001 | McLeod et al. | |

(Continued)

*Primary Examiner*—Lori Amerson
(74) *Attorney, Agent, or Firm*—Carter DeLuca Farrell & Schmidt LLP

(57) ABSTRACT

A therapeutic device, such as an exercise device, includes the principles of osteogenic repair by incorporating a vibrational loading mechanism into the exercise device. By doing so, the therapeutic device provides an increased osteogenic effect, thereby enhancing the benefits of the therapy. As an example, an exercise device includes a support surface for supporting all or part of the bodily tissue of an individual using the device. A linear or rotary vibrational loading mechanism associated with the frame or a rotational element of the exercise device drives the support surface at a selected load and frequency, thereby inducing mechanical loading of bodily tissue adjacent to the support surface sufficiently to facilitate the growth, development, strengthening, and/or healing of bone tissue. The vibrational loading mechanism may be incorporated into any exercise device, including standard exercise devices such as rowing machines, stair climbing machines, elliptical trainers, bicycles, cross-country ski trainers, treadmills, or weight trainers.

33 Claims, 9 Drawing Sheets

U.S. PATENT DOCUMENTS 6,258,020 B1 7/2001 Lopez
6,620,117 B1 * 9/2003 Johnson et al. ..... 601/90
6,656,137 B1 * 12/2003 Tyldsley et al. ..... 601/15
6,659,918 B2 * 12/2003 Schiessl ..... 482/92
6,695,799 B2 * 2/2004 Kitadou et al. ..... 601/49
2002/0087104 A1 * 7/2002 Huang ..... 601/33

* cited by examiner

EXERCISE EQUIPMENT UTILIZING MECHANICAL VIBRATIONAL APPARATUS

FIELD OF THE INVENTION

The present invention relates to a therapeutic apparatus and, more specifically, to an apparatus for enhancing the benefits of exercise and physical therapy with osteogenic healing.

BACKGROUND OF THE INVENTION

The benefits of exercise and physical therapy have been well documented and include aerobic conditioning, strength enhancement, and rehabilitation. Exercises such as walking, running, weight lifting, bicycling, swimming, and rowing have also been proven beneficial in osteogenic repair and maintenance. More specifically, a program of exercise has been proven to stimulate bone-tissue cell activity through the application of mechanical loading at specific frequency levels to facilitate bone tissue growth, repair, and maintenance. However, to attain such osteogenic benefits from exercise, oftentimes the exercise must be sustained for extended periods of time and the regimen maintained indefinitely. Furthermore, regular and extended aggressive exercise and impact loading used as a bone-tissue treatment protocol may be both difficult to maintain and dangerous to the participant, especially the elderly. In fact, high loading activity could precipitate the fracture that the exercise was intended to prevent.

U.S. Pat. Nos. 5,103,806, 5,191,880, 5,273,028 and 5,376,065 to McLeod et al., the contents of each being incorportated herein by reference, relate to noninvasive methods and apparatus for preventing osteopenia, promoting bone tissue growth, ingrowth, and healing of bone tissue. As disclosed U.S. Pat. Nos. 5,273,028 and 5,376,065, the application of physiologically-based relatively high frequency, relatively low level mechanical load-to-bone tissue at the proper parameters provides significant beneficial effects with respect to bone tissue development and healing. These patents disclose an apparatus for imparting the desired mechanical load to the bone. The apparatus includes a surface upon which a patient may sit or stand. An actuator or transducer is positioned under the surface to provide the vibration necessary to achieve the desired osteogenic benefits. The methods and apparatii disclosed in these patents have proven successful in preventing bone loss or osteopenia and encouraging new bone formation.

SUMMARY OF THE INVENTION

The present invention is directed to systems and methods for combining the principles of osteogenic repair with therapeutic measures to thereby increase the osteogenic effect, as well as to obtain the benefits of therapies such as exercise, including but not limited to muscle tissue development and aerobic conditioning. One advantage of this invention over conventional exercise regimens and conventional osteogenic treatment is that a patient may optimize the time the patient spends receiving osteogenic treatments. In this manner, the invention has the potential to improve patient compliance with an osteogenic regimen.

According to one aspect of the various embodiments of the invention, osteogenic treatments are delivered to a patient who is exercising or undergoing a therapeutic treatment using a therapeutic device. As used herein, "therapeutic device" refers to any exercise or other type of device designed to impart a beneficial effect to one or more portions of a patient's body, with or without the active participation of the patient. The phrase "exercise" refers to activity undertaken to achieve a beneficial effect, such as improved physical fitness or ability, range of motion, balance, coordination, flexibility, weight control, cardiovascular health, pain relief, stress relief, healing, strength, speed, endurance, or general physical and mental health and well being.

The therapeutic device includes means for developing or maintaining fitness of bodily tissue or organs, which, in certain embodiments is an exercise device. The exercise device includes a frame and/or a support surface for supporting at least a portion of the bodily tissue of an individual using the device. According to an aspect of this invention, at least one loading means, is associated with the frame and/or support surface for driving the support surface at a selected load and frequency. The term "loading means" includes, without limitation, vibrational loading mechanisms such as linear or rotary loading mechanisms, further linear actuators, rotary actuators, actuators that provide both linear and rotary motions, transducers and the like. The loading mechanism thereby induces mechanical loading of bodily tissue adjacent to or supported by the support surface sufficient to facilitate the growth, development, strengthening, and/or healing of bone tissue. The loading mechanism may include an actuator or transducer operatively associated with the support surface. The loading mechanism may be associated with a support surface of any exercise device, including standard exercise devices such as rowing machines, stair climbing machines, elliptical trainers, bicycles, cross-country ski trainers, treadmills, Pilates machines, or weight training machines. As used herein, the term "means for developing or maintaining fitness of bodily tissue or organs" includes, without limitation all of the above-mentioned exercise devices and any equivalents thereof. The support surface may be a stationary element of the exercise device, such as a seat, or an active element, such as a pedal. When the patient uses the therapeutic device of the present invention, the benefits associated with the intended therapy are thereby enhanced by the additional mechanical loading supplied by the loading mechanism.

In conjunction, or in the alternative, at least one loading mechanism can be associated with a rotational element of the exercise device, according to this invention. According to this aspect, an appendicular support surface of the rotational element, such as a pedal or handle, delivers mechanical loading to the patient's body part that contacts the surface, as the patient grips or presses the appendicular support surface of the rotational element of the exercise device.

The various embodiments of the invention provide a method of developing and maintaining fitness of bodily tissue and organs and healing, strengthening, and promoting growth of bone tissue. The therapeutic device is provided by associating a transducer or other loading mechanism with the support surface. If the loading mechanism is a rotary loading mechanism, the loading mechanism is also associated with a rotational element of the therapeutic device, the rotational element being associated with the support surface. Healing, strengthening, and promoting growth of bone tissue is accomplished at least in part by adapting each linear or rotary loading mechanism to load the bodily tissue at a frequency ranging from about 10 Hz to about 100 Hz, and within a range up to an upper limit of about 2 millimeters displacement peak-to-peak.

Additional objects, advantages and novel features of the invention will be set forth in part in the description which follows, and in part will become more apparent to those skilled in the art upon examination of the following, or may be learned by practice of the invention.

BRIEF DESCRIPTION OF THE DRAWINGS

The accompanying drawings, which are incorporated in and form part of the specification, illustrate the present invention when viewed with reference to the description, wherein.

DETAILED DESCRIPTION OF THE INVENTION

The present invention incorporates an osteogenic loading mechanism into therapeutic equipment. In certain embodiments of the invention, applied use induces mechanical strains on the order of 50 to 500 microstrain (i.e., 50–500 times $10^{-6}$ strain) with a frequency range of 10 to 100 Hz, and preferably within the range of 15 to 30 Hz, into the appendicular and/or axial skeleton. The strain may be induced with peak-to-peak displacements of no more than about 2 millimeters. Such parameters provide at least the following beneficial effects: 1) maintenance of bone mass/prevention of osteoporosis; 2) promotion of bone ingrowth into implants or prosthesis; and 3) acceleration of fracture healing. Further details of the loading mechanism may be ascertained by reference to the McLeod patents.

Figure 1:
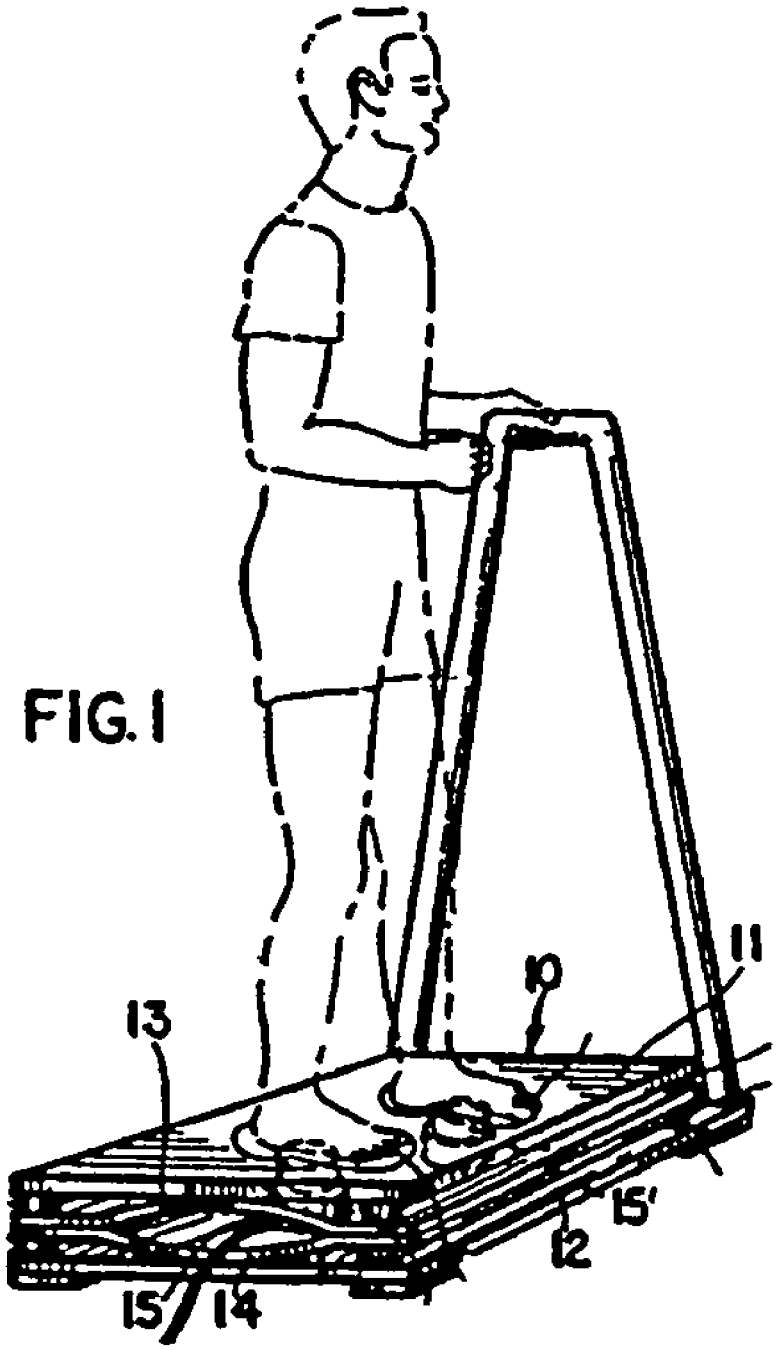
FIG. 1 PRIOR ART
FIG. 1 illustrates an exemplary linear loading mechanism for providing mechanical and cyclical loading to facilitate osteogenesis as disclosed in U.S. Pat. Nos. 5,273,028 and 5,376,065.

FIG. 1, as disclosed in U.S. Pat. Nos. 5,273,028 and 5,376,065 to McLeod et al., the entirety of which have been previously incorporated herein by reference, illustrates one embodiment of a loading mechanism for mechanically and cyclically loading bone tissue to induce bone growth for osteogenic repair of bone tissue. Briefly stated, the linear loading mechanism 10 of FIG. 1 includes upper and lower rigid plates 11, 12 spaced apart by two oppositely bowed sheets 13, 14, (e.g., of spring steel). The opposite bowing of sheets 13, 14 creates a vertical separation between the sheets 13, 14 to permit mounting of an actuator or transducer 15, 15' between the bowed region of sheets 13, 14. The patient stands or sits stationary on the rigid plate 11 and, upon activation, the actuator or transducer stimulates the rigid plates 11, 12 to impart mechanical stress to the patient. The patents disclose means for activating and controlling the load delivered to the patient. The strain resulting from this stress causes the desired osteogenesis. Any effective method or means for creating a coordinated displacement between the rigid plates 11, 12 may be used to deliver a mechanical load to a patient and all such methods or means are within the scope of the invention.

Figure 2:
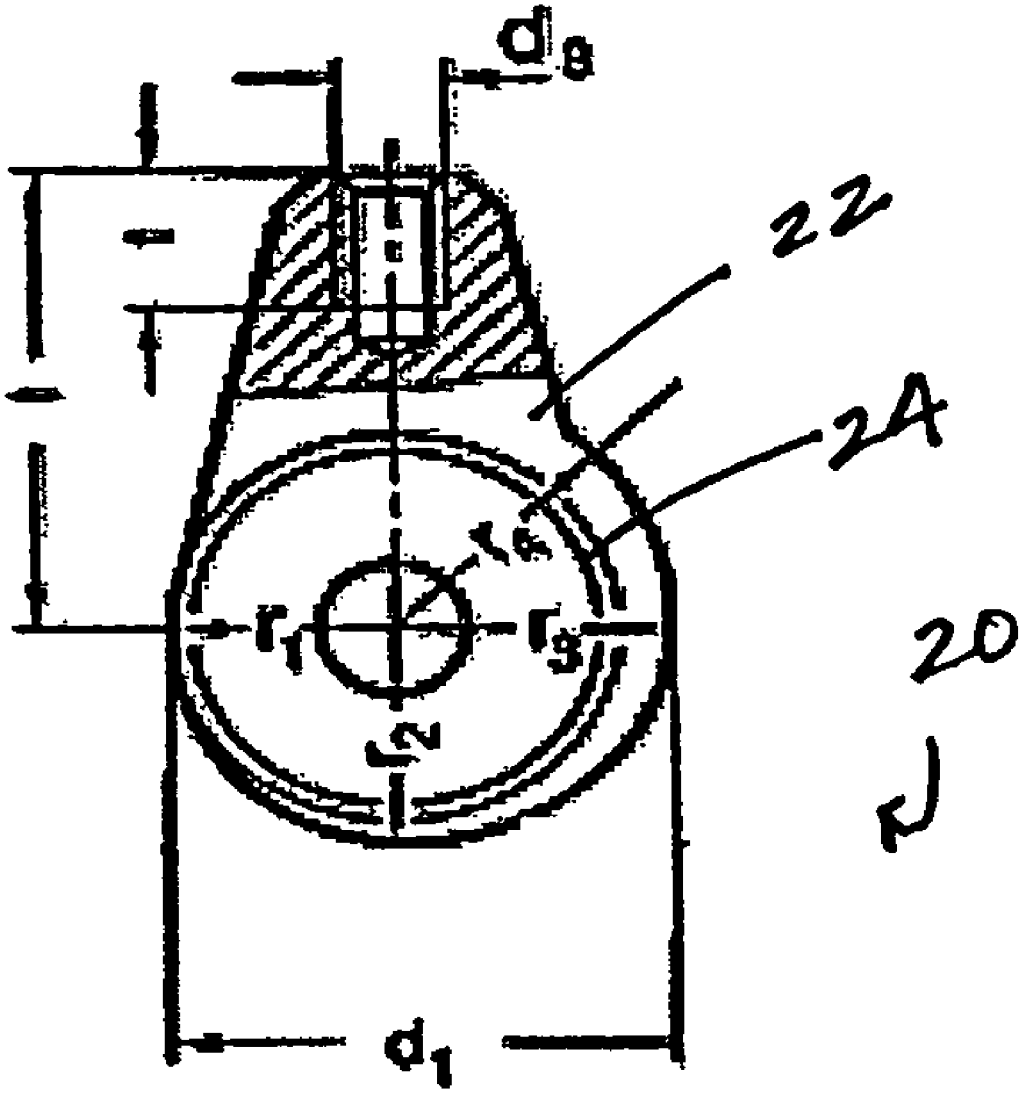
FIG. 2 PRIOR ART
FIG. 2 illustrates an exemplary rotary loading mechanism for providing mechanical and cyclical loading to facilitate osteogenesis.
Figure 3:
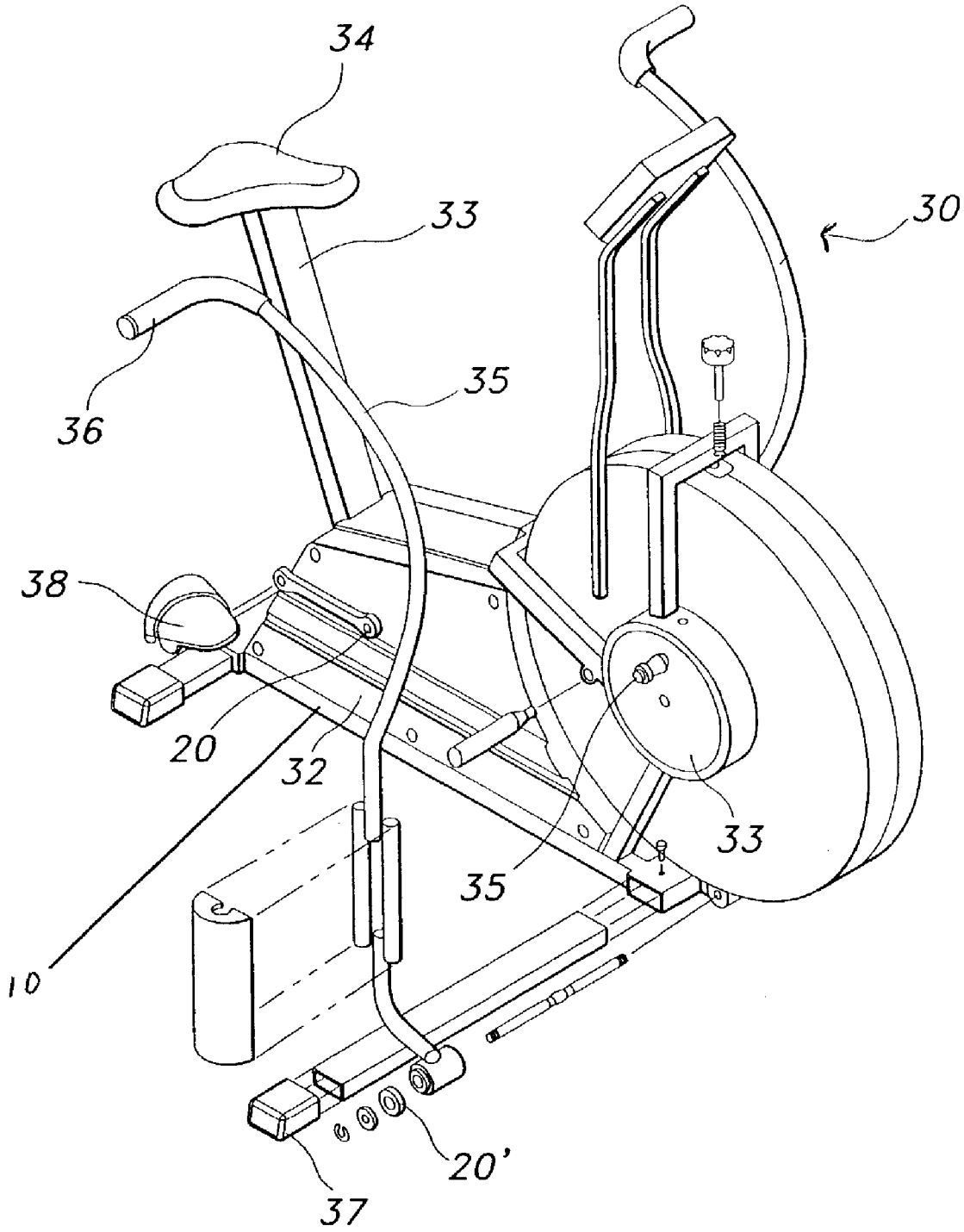
FIG. 3 is a perspective view of a stationary bicycle that incorporates linear and rotary loading mechanisms, according to various aspects of the invention.

Another way of delivering a mechanical load to a patient is with a rotary loading mechanism 20, as shown in FIG. 2. The device illustrated includes a rotary actuator or transducer, such as an eccentric cam. The rotary loading mechanism 20 is rotatably supported and aligned with a pivot axis of a shaft or similar component of an exercise machine. In FIG. 2, the rotary actuator or transducer converts mechanical or electromechanical energy into vibrational stimulation of the appendicular support surface. In the embodiment shown, an eccentric cam comprises a revolving disk and shaft assembly 22 with the axis of rotation displaced from the geometric center of the revolving disk 24, as indicated by the various unequal radii depicted as $r_1$, $r_2$, $r_3$, and $r_4$. Eccentricity can also be attained by creating deformations on the surface of the revolving disk 24 such that the deformations interact with the rotational mechanism of the shaft assembly 22 to produce vibration. As power is applied to the shaft and the motor is thus turned, its surface comes into contact at various points with the inner surface of the stator. The rotation of the roar and subsequent contact between its outer surface and the stator causes the assembly to vibrate. Because the stator is rigidly, or semi rigidly attached to the exercise device, this vibration is transferred to the exercise device, and hence to the patient using the exercise device.

The eccentric cam may be combined with other elements to form an electromechanical actuator such as an actuator including a rotor and a stator. An electromechanical actuator improves the flexibility of the exercise device, by reducing the correlation between the rate at which the patient operates the device and the frequency of the resultant vibration. The electromechanical actuator can be preset and adjustable so as to deliver stimulation at the desired frequency regardless of the speed at which the patient moves the exercise device, such as by pedaling, stepping, walking, or swinging arm levers.

FIGS. 3–9 illustrate alternative therapeutic devices in which a loading mechanism, such as the linear loading mechanism disclosed in U.S. Pat. Nos. 5,273,028 and 5,376,065, or the rotary loading mechanism disclosed in FIG. 2, may be incorporated to combine the osteogenic benefits of mechanical loading with therapeutic effects, such as the aerobic and strength benefits inherent in exercise. Additional mechanical loading capabilities may be imparted to the therapeutic devices in a variety of ways.

To establish the desired amplitude of resonance in the targeted bodily tissue, it is advantageous to impart mechanical and cyclical strain while the bodily tissue is simultaneously mechanically stressed, either by the static interaction of gravity with body weight, or by exertion of the muscles in the targeted bodily tissue. Moreover, the mechanical and cyclical strain is preferably applied so as to produce stimulating displacements in alignment with the mechanical stress.

In certain embodiments, the entirety or a portion of a therapeutic device rests on a substrate having a linear loading mechanism. Activation of the linear loading mechanism and consequent stimulation of the substrate thereby stimulates the therapeutic device or part thereof resting on the substrate. In these embodiments, mechanical and cyclical strain may be primarily imparted to the axial skeleton. The simultaneous mechanical stress is provided by static gravitational strain. For example, the loading mechanism may include a piezoelectric transducer. The transducer is coupled to the therapeutic device so as to vibrate the device at a frequency ranging from about 10 Hz to about 100 Hz. Desirably, the transducer provides a peak-to-peak displacement of up to 2 mm.

In other embodiments, a linear or rotary loading mechanism is incorporated into a dynamic, i.e., movable, element of the physical structure of the therapeutic device to impart the desired stimulation. In this way, the mechanical and cyclical loading of different parts of the device, and thus of different parts of the patient, may be controlled. For example, a loading mechanism 10, 20 may be incorporated into a stationary bicycle 30, such as that disclosed in U.S. Pat. No. 4,917,376 to Lo, the contents of which are incorporated herein by reference, to cause vibration of the entire bicycle or just a portion thereof (for example, to appendicular support surfaces such as handlebars 36, or pedals 38). As shown schematically in FIG. 3, the linear loading mechanism 10 of FIG. 1 may be incorporated into the base 32 of the bicycle 30 to impart mechanical and cyclical loading indirectly via a seat support member 33 into the seat 34 of the bicycle 30. The linear loading mechanism 10 can also be incorporated directly into the seat 34 of the bicycle 30. In either configuration, the linear loading mechanism 10 is positioned and calibrated to provide the desired mechanical and cyclical loading to achieve osteogenesis, such as to relieve or reverse osteopenia of the spine while providing the aerobic and strength enhancing qualities of the exercise bike 30. In the alternative, or in conjunction, a rotary loading mechanism 20 can be incorporated into a rotational element of the bicycle 30. For example, the exercise bicycle of FIG. 3 includes swing levers 35 positioned to be swung manually each in an opposite direction toward and away from the torso of the patient. The patient alternately pushes and pulls the handles 36 of the swing levers 35 to achieve the swinging motion. A rotary loading mechanism 20 can be incorporated at the pivot axis 37 of each swing lever 35 so as to impart mechanical strain to targeted bones. Rotary loading mechanisms 20 can also be incorporated in each pedal assembly 38 and in any of the sprocket assemblies 39 included in the bicycle 30.

In use, a patient operates the bicycle 30 in an ordinary manner, in that no unusual steps or motions are required. The patient's feet push the pedal assemblies 38 while the patient sits on the seat 34, which may be vertically adjustable by telescopic movement of the seat support member 33. While the patient sits on the seat 34, one or more linear loading mechanisms 10 can be activated so as to drive the support surface, e.g., the seat 34. Each linear loading mechanism 10 interacts with the axial compressive static strain on the patient's spine and pelvic girdle caused by body weight. This interaction mechanically and cyclically imparts negative force in the form of compression and positive force in the form of tension to the spine and other axial members of the patient's skeleton. The resultant strain induces a sinusoidal displacement of the patient's bodily tissue that preferably does not exceed 2 millimeters. Movement of the pedal assemblies 38 rotates a sprocket 39, which is integral to a mechanism for generating resistance against the patient's efforts to pedal the exercise bicycle 30. While the patient moves the pedal assemblies 38, one or more rotary loading mechanisms 20 can be activated so as to interact with compressive forces caused by the bicycle's resistance opposing at least the proximal, middle, and distal segments of the lower members of the patient's appendicular skeleton.

As a result, the invention can apply strain to elements of either or both the axial or the appendicular skeleton that are concurrently experiencing muscular stress. This is believed to increase the benefit of the treatment to the patient.

Preferably, the loading mechanisms 10 and 20 can be adjusted to vary the strain imparted, and the frequency at which the loading cycles. For instance, the therapeutic device preferably provides the desired strain at the desired frequency regardless of the patient's weight, level of exertion, or exercise rate. Methods of controlling the strain and frequency of a linear loading mechanism 10 are described in U.S. Pat. No. 5,376,065. In addition, the control panels of the exercise devices can be adapted for entry of pertinent information about the patient, such as weight, strength level, existence of injury, etc., which can determine the appropriate amount of strain for that patient. User entry is particularly useful for controlling strain and frequency in a rotary loading mechanism 20, which is not as dependent upon body weight.

Other therapeutic devices, including but not limited to rowing machines, stair climbing machines, elliptical trainers, cross-country ski trainers, and treadmills, may be similarly adapted to impart mechanical and cyclical loading to appendicular support surfaces, such as seat supports, foot supports, to axial support surfaces, such as the base or other stationary component, or to a combination thereof or a component of either or both appendicular and axial support surfaces. Although the figures and description below may reference the use of both linear and rotary loading mechanisms for illustrative purposes, it will be understood that either loading mechanism may be present alone in a particular embodiment.

Figure 4:
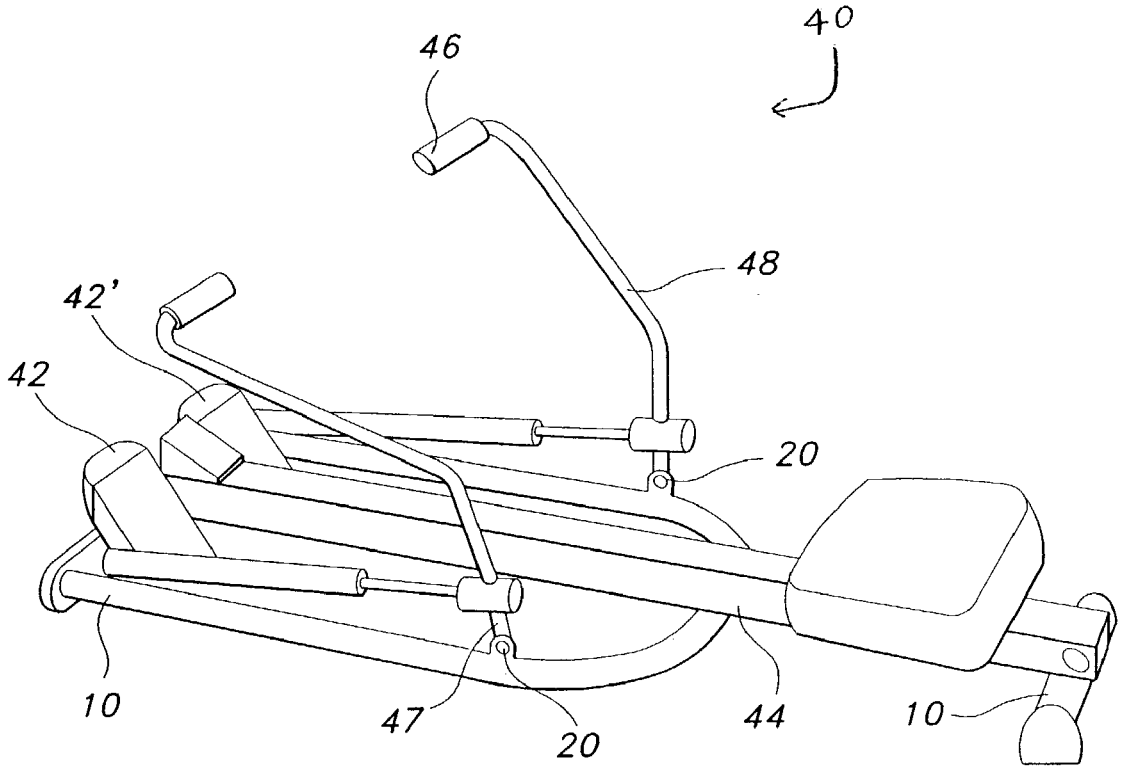
FIG. 4 is a perspective view of a rowing machine according to an exemplary embodiment of the invention.

For example, FIG. 4 illustrates a rowing machine 40. The loading mechanisms 10, 20 of this invention can be implemented in several different elements of the rowing machine 40. A linear loading mechanism 10 can be incorporated into the base of the rowing machine 40 at any of a number of locations on the frame. For instance, a linear loading mechanism 10 can be placed adjacent to foot rests 42, 42' or positioned where the rigid frame 44 contacts the floor. As a result, either the first rate or the entire frame can be cyclically loaded. In addition a rotary loading mechanism 20 positioned adjacent to the handlebars 46, e.g. a pivot point 47 of a swing lever 48, can impart mechanical and cyclical loading to a patient's arms. A seat 49 may also include mechanisms to generate a mechanical stress to a user seated thereon.

Figure 5:
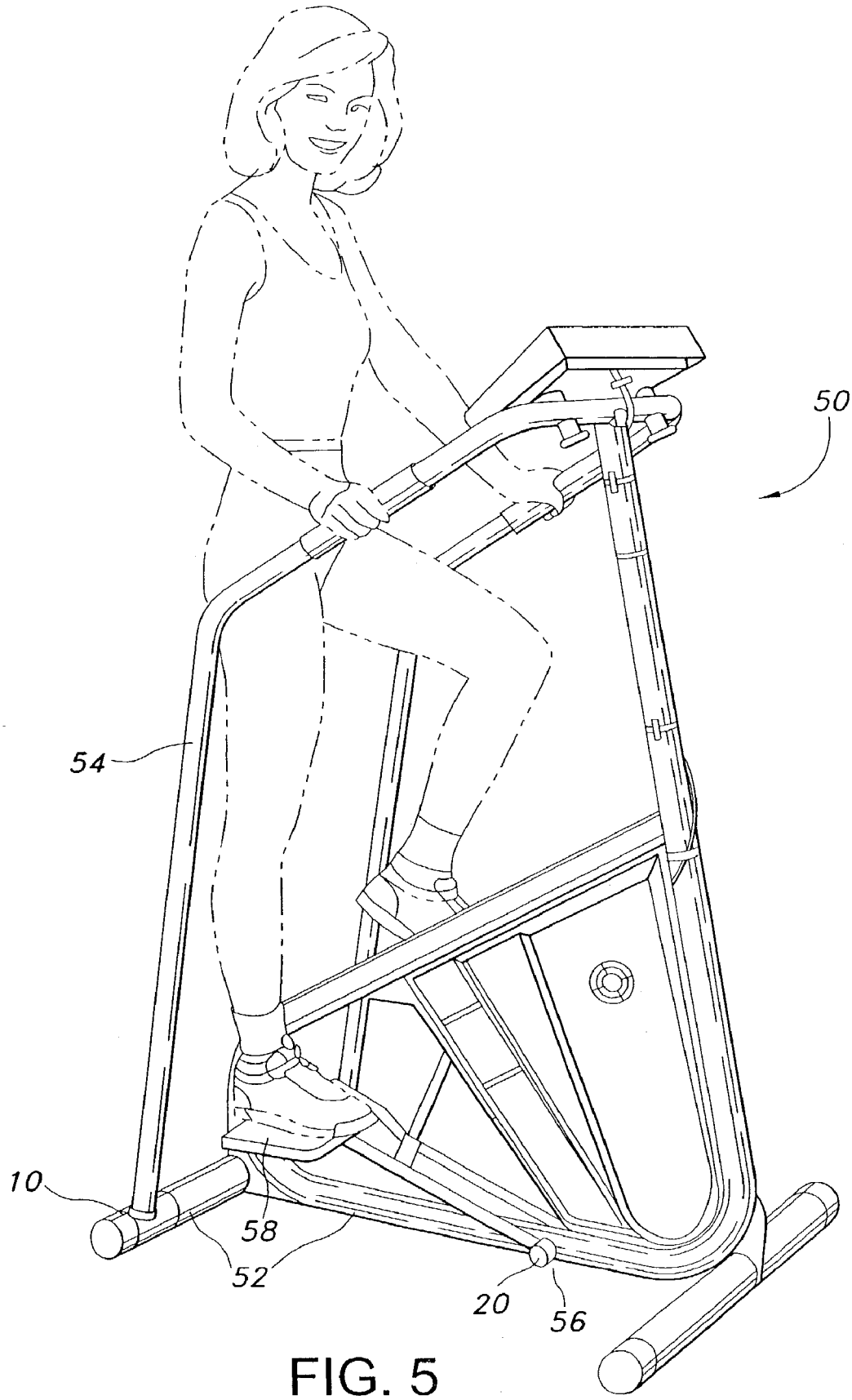
FIG. 5 is a perspective view of a stair climbing machine according to an exemplary embodiment of the invention.

FIG. 5 illustrates a stair climbing machine 50 disclosed in U.S. Pat. No. RE34,959 to Potts, the contents of which are incorporated by reference. A linear loading mechanism 10 can be incorporated in the base 52 to impart mechanical and cyclical loading to patient's upper appendages and torso via the bars 54, when the patient uses the bars 54 to support a portion of the patient's body weight. A rotary loading mechanism 20 can be incorporated at the pivot point 56 of the stepping mechanism, so as to impart mechanical and cyclical loading to the patient's lower appendages and torso via the pedals 58.

Figure 6:
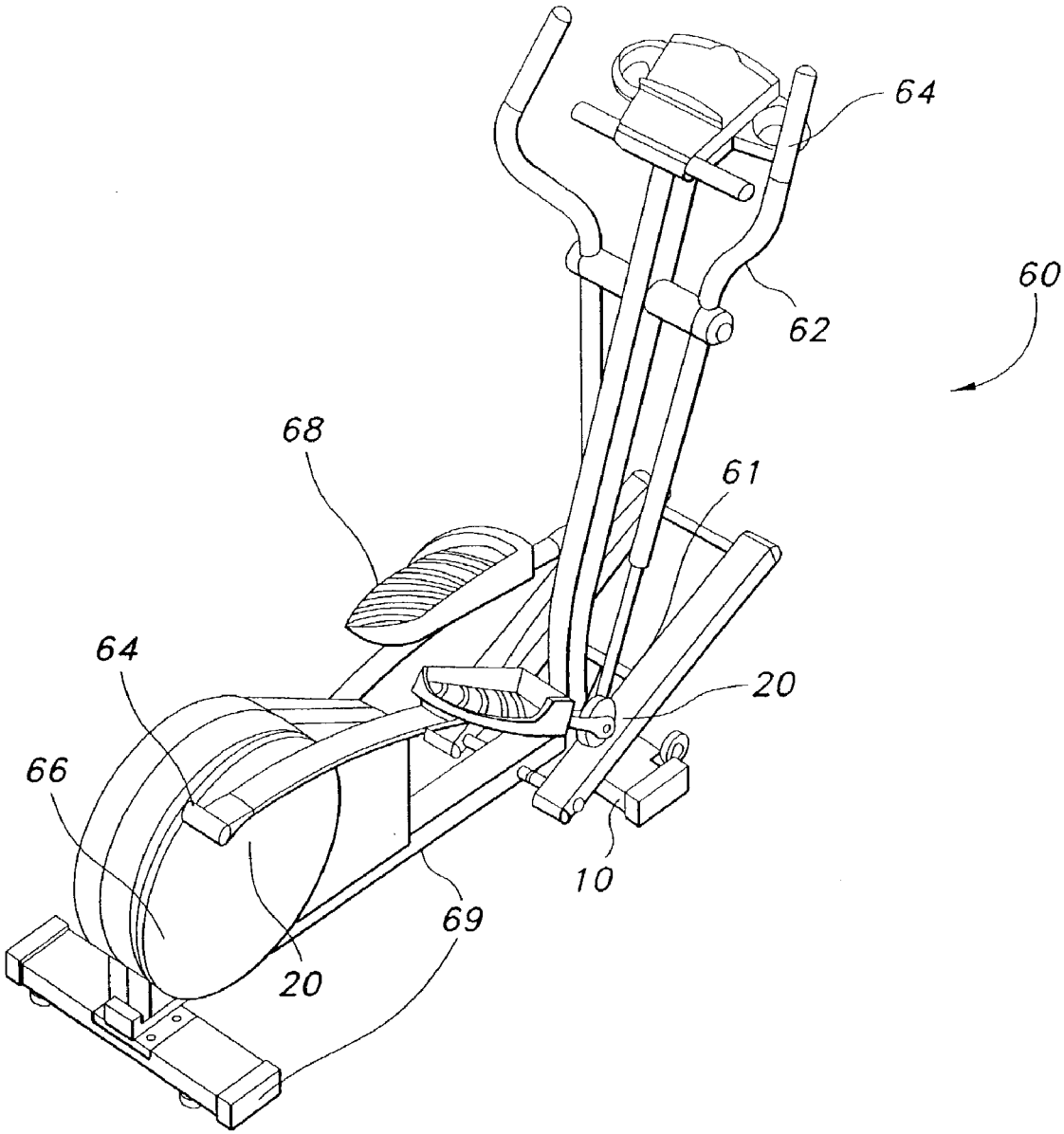
FIG. 6 is a perspective view of an elliptical trainer according to an exemplary embodiment of the invention.

FIG. 6 illustrates an elliptical trainer 60. Rotary loading mechanisms 20 can be incorporated into the pivot points 61 of the swing levers 62 so as to impart mechanical and cyclical loading to the patient's upper appendages and torso via handles 64. Rotary loading mechanisms 20 can also be incorporated into the flywheel 66 components or pedal bushings 67 of the elliptical trainer 60, so as to impart mechanical and cyclical loading to the patient's lower appendages and torso via pedals 68. A linear loading mechanism 10 can also be incorporated into the base 69 of the elliptical trainer 60.

Figure 7:
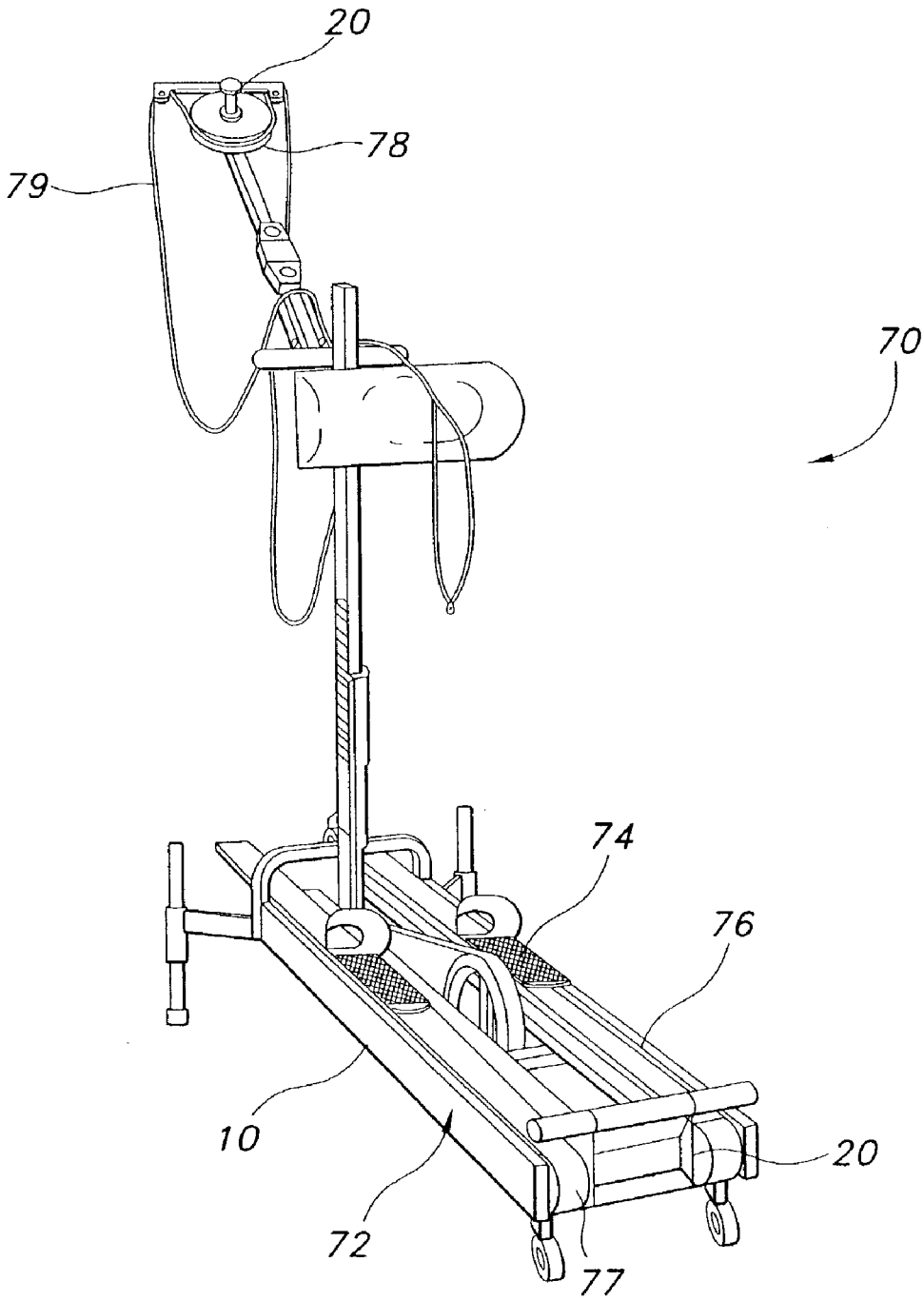
FIG. 7 is a perspective view of a cross-country ski trainer according to an exemplary embodiment of the invention.

FIG. 7 illustrates a cross-country ski trainer 70 disclosed in U.S. Pat. No. 5,000,442 to Dalebout et al., incorporated herein by reference. A linear loading mechanism 10 can be incorporated in the base 72 of the ski trainer 70 to impart mechanical and cyclical loading to the foot plate 74 of each ski 76. Alternatively, or in addition, rotary loading mechanisms 20 can be incorporated into the roller mechanism 77 that imparts motion to the skis. Rotary loading mechanisms 20 can also be incorporated in the pulleys or pivot points 78 of the arm cords or swing levers 79, respectively.

Figure 8:
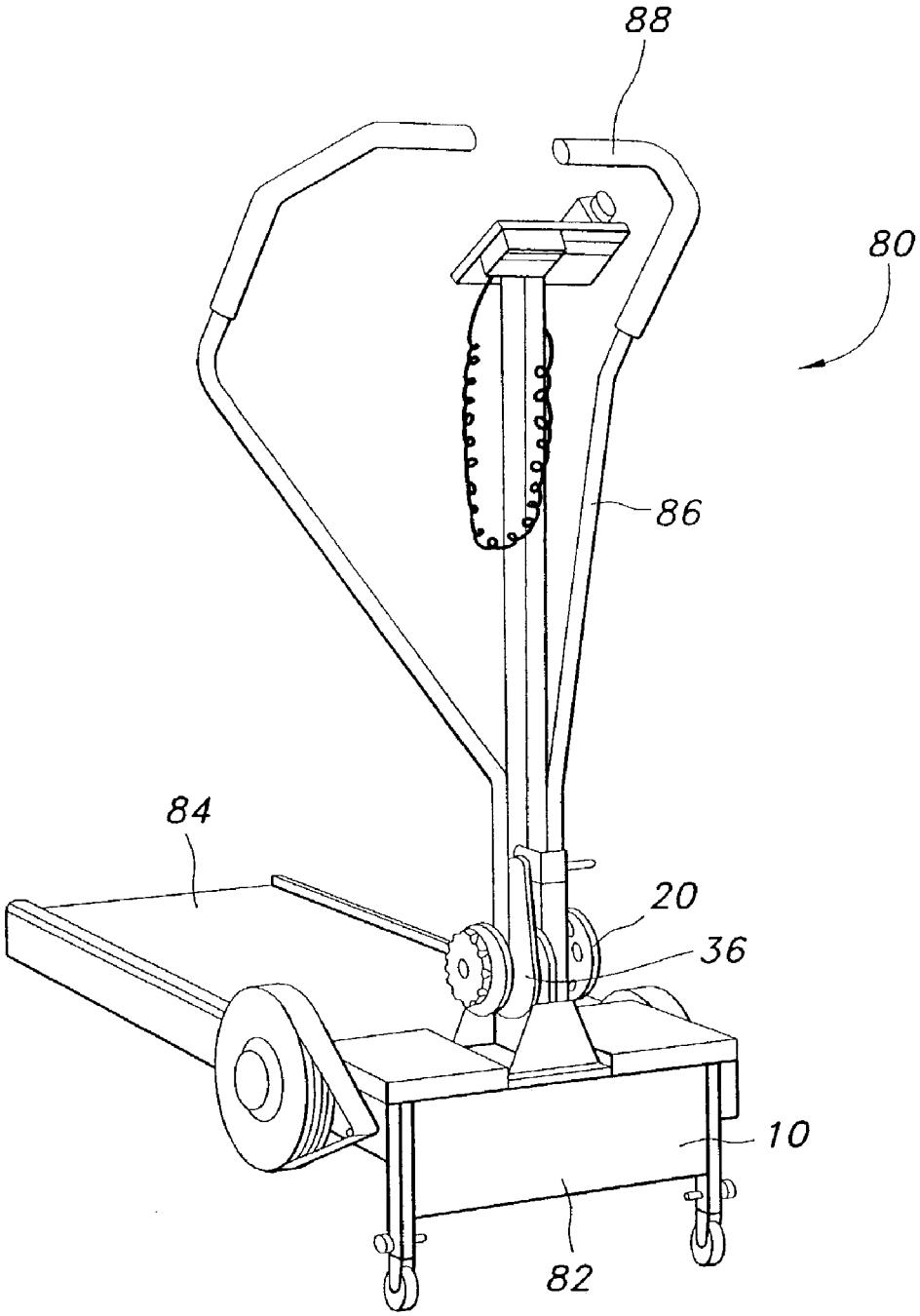
FIG. 8 is a perspective view of a treadmill according to an exemplary embodiment of the invention.

FIG. 8 illustrates a treadmill 80 disclosed in U.S. Pat. No. 5,431,612 to Holden, incorporated herein by reference. A linear loading mechanism 10 can be incorporated into the base 82 of the treadmill 80 so as to impart mechanical and cyclical loading via the treading surface 84. Rotary loading mechanisms 20 can be incorporated at the pivot point 84 of each swing arm 86 so as to impart mechanical and cyclical loading via each handle 88.

Figure 9:
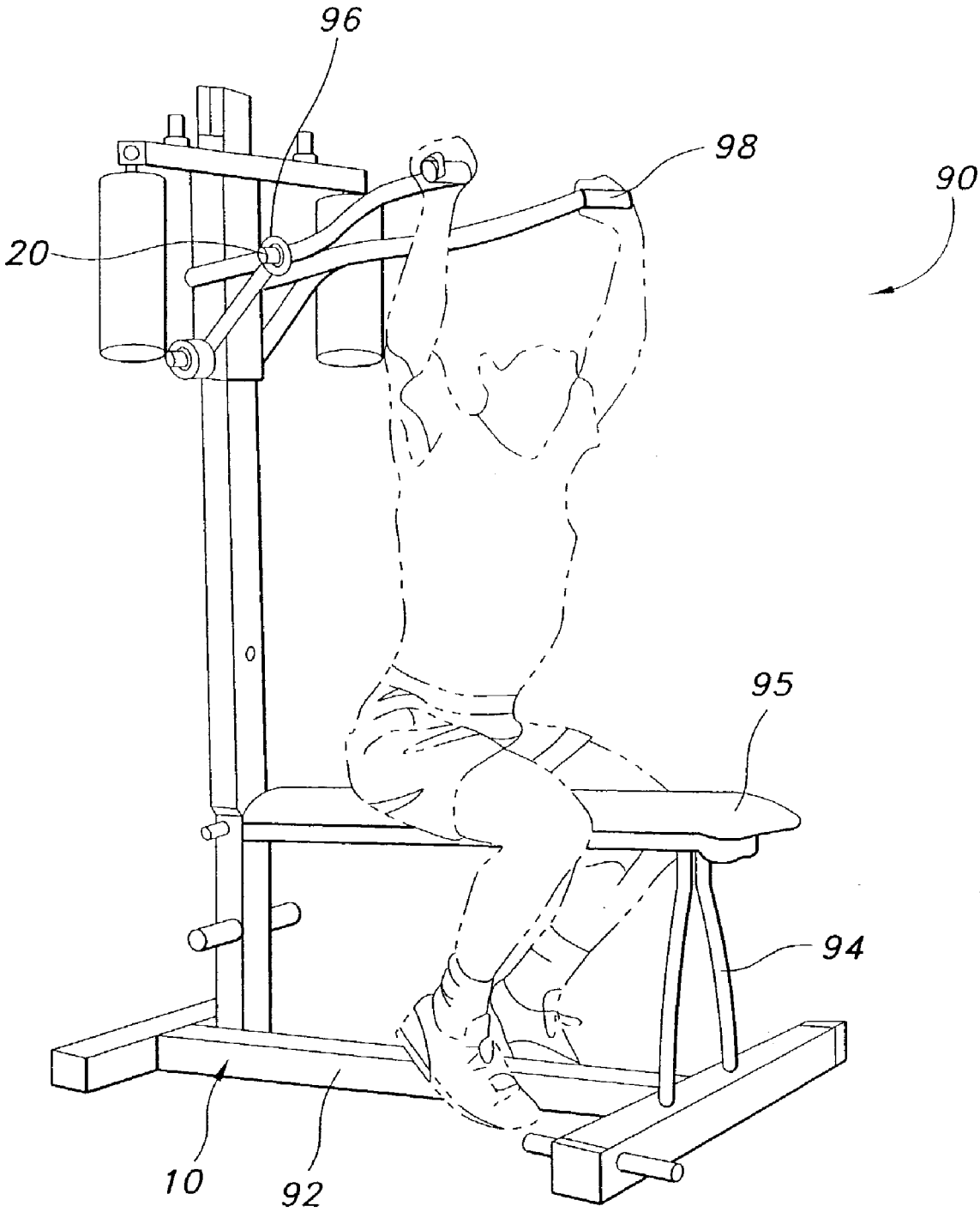
FIG. 9 is a perspective view of a weight training machine according to an exemplary embodiment of the invention.

FIG. 9 illustrates a weight training machine 90. A linear loading mechanism 10 can be incorporated into the base 92 so as to impart mechanical and cyclical loading to the patient's spine and axial skeleton via upright supports 94 and the seat 95. Rotary loading mechanisms 20 can be incorporated at pivot points 96 of the handles 96 so as to impart mechanical and cyclical loading to the patient's upper appendicular skeleton as the patient pushes or pulls the handles 96 obtain the desired resistance for the weight training effect.

Incorporation of a loading mechanism into therapeutic equipment is not limited to stationary equipment, but rather may also be utilized with a mobile therapeutic device, such as a bicycle. All of these or similar devices may incorporate the mechanical and cyclical linear or rotary loading mechanisms in accordance with the principles of the present disclosure.

One skilled in the art may readily appreciate various arrangements to mount the loading mechanism to or incorporate the loading mechanism into the therapeutic device. For example, the loading mechanism may be in the general shape of or attached to one or more weight bearing elements of the equipment. For example, the loading mechanism maybe part of or shaped of, or attached to the seat of the therapeutic device, e.g. mounted to the underside of the surface with fixation devices such as bolts or other appropriate fasteners. Additionally, or alternatively, the loading mechanism may be shaped as, and attached to, the foot supports of the therapeutic device, such as the pedals of a bicycle, foot rests of the stair climber, elliptical trainer, and cross-country ski trainer, or the flat plate under the tread of the treadmill. Each therapeutic device may include any combination of mechanical and electromechanical linear or rotary loading mechanisms, each being incorporated in an element of the therapeutic device so as to achieve the desired osteogenic result. In some embodiments, each of the various types of therapeutic equipment could be supported on a device that would transmit a mechanical loading to the equipment relative to the ground.

The foregoing is provided for the purpose of illustrating, explaining and describing embodiments of the present invention. Further modifications and adaptations to these embodiments will be apparent to those skilled in the art and may be made without departing from the spirit of the invention or the scope of the following claims. For example, the therapeutic devices described herein do not represent an exhaustive list of possible embodiments, and are not intended to limit the invention to the precise forms disclosed. Furthermore, the principles of cyclical mechanical loading can be implemented in any element of a therapeutic device through which stimulation can be transferred to appropriate physiological structures.

What is claimed is:

1. A therapeutic device comprising:

a. an exercise device including a support surface for supporting at least part of the bodily tissue of an individual; and b. a rotary vibrational loading mechanism associated with the support surface for driving the support surface at a selected load and frequency to induce mechanical vibration sufficient to facilitate bone growth or healing of bodily tissue and for inducing mechanical strain in the range of about 50 microstrain to about 500 microstrain into at least one of a user's appendicular skeleton and axial skeleton, wherein the rotary vibrational loading mechanism is adapted to be driven so as to have a peak-to-peak displacement up to about 2 millimeters.

2. The therapeutic device of claim 1, wherein the support surface is a component of a seat support.

3. The therapeutic device of claim 1, wherein the support surface is a component of a lower extremity support.

4. The therapeutic device of claim 1, wherein the support surface is a component of a foot support.

5. The therapeutic device of claim 1, wherein the support surface is a component of an upper extremity support.

6. The therapeutic device of claim 1, wherein the support surface is a component of a handle.

7. The therapeutic device of claim 1, wherein the rotary vibrational loading mechanism comprises a transducer.

8. The therapeutic device of claim 7, wherein the transducer is adapted to be driven so as to vibrate the bodily tissue at a frequency ranging from about 10 Hz to about 100 Hz.

9. The therapeutic device of claim 1, wherein the displacement caused by the rotary vibrational loading mechanism is sinusoidal.

10. The therapeutic device of claim 1, wherein the exercise device comprises a stair climbing machine.

11. A therapeutic device comprising:

a. an exercise device with a support surface for supporting at least part of the bodily tissue of an individual, wherein the support surface is associated with a rotational element; and b. a rotary vibrational loading mechanism operatively associated with the rotational element for driving the support surface at a selected load and frequency to induce mechanical vibration sufficient to facilitate bone growth or healing of bodily tissue and for inducing mechanical strain in the range of about 50 microstrain to about 500 microstrain into at least one of the appendicular skeleton and axial skeleton, wherein the rotary vibrational loading mechanism is adapted to be driven so as to have a peak-to-peak displacement up to about 2 millimeters.

12. The therapeutic device of claim 11, wherein the rotary vibrational loading mechanism comprises a transducer.

13. The therapeutic device of claim 11, wherein the transducer is adapted to be driven so as to vibrate the bodily tissue at a frequency ranging from about 10 Hz to about 100 Hz.

14. The therapeutic device of claim 11, wherein the displacement caused by the rotary vibrational loading mechanism is sinusoidal.

15. The therapeutic device of claim 12, where the transducer comprises an eccentric cam.

16. The therapeutic device of claim 11, wherein the support surface is a component of a foot support.

17. The therapeutic device of claim 11, wherein the support surface is a component of a handle.

18. The therapeutic device of claim 11, wherein the rotational element is a component of a stair climbing machine.

19. A therapeutic device comprising:

a. an exercise device including means for developing or maintaining fitness of bodily tissue or organs comprising a frame defining a support surface for supporting an individual; and b. rotary vibrational loading means associated with the frame for driving the support surface at a selected load and frequency to induce mechanical vibration of bodily tissue sufficient to facilitate bone growth or healing of bodily tissue, wherein the rotary vibrational loading means is adapted to be driven so as to have a peak-to-peak displacement up to about 2 millimeters.

20. The therapeutic device of claim 19, wherein the rotary vibrational loading means comprises a transducer operatively associated with the support surface.

21. The therapeutic device of claim 20, wherein the transducer is adapted to be driven so as to vibrate the bodily tissue at a frequency ranging from about 10 Hz to about 100 Hz.

22. The therapeutic device of claim 19, wherein the displacement caused by the rotary vibrational loading means is sinusoidal.

23. The therapeutic device of claim 19, wherein the support surface is a component of a seat support.

24. The therapeutic device of claim 19, wherein the support surface is a component of a foot support.

25. A therapeutic device comprising:

a. an exercise device including means for developing or maintaining fitness of bodily tissue or organs comprising a frame defining a support surface for supporting an individual, wherein the means for developing or maintaining fitness of bodily tissue or organs comprises a stair climbing; and b. rotary vibrational loading means associated with the frame for driving the support surface at a selected load and frequency to induce mechanical vibration of bodily tissue sufficient to facilitate bone growth or healing of bodily tissue, wherein the rotary vibrational loading means is adapted to be driven so as to have a peak-to-peak displacement up to about 2 millimeters.

26. A method of developing and maintaining fitness of bodily tissue or organs or of healing, strengthening, or promoting growth of bone tissue, or any combination thereof comprising:

providing a therapeutic device comprising an exercise device that includes a support surface for supporting at least part of the bodily tissue of an individual and that includes a rotary vibrational loading mechanism associated with the support surface;

vibrating the support surface at a selected load and frequency to induce mechanical vibration sufficient to facilitate bone growth or healing of the bodily tissue;

displacing the bodily tissue up to about 2 millimeters peak to peak; and inducing mechanical strain in the range of about 50 microstrain to about 500 microstrain into at least one of the appendicular skeleton and axial skeleton.

27. The method of claim 26, wherein the mechanical vibration is provided by an eccentric cam.

28. The method of claim 26, wherein the mechanical vibration is provided by a transducer.

29. The method of claim 26, wherein the mechanical vibration is provided at a frequency ranging from about 10 Hz to about 100 Hz.

30. The method of claim 26, wherein the mechanical vibration is sinusoidal.

31. A method of developing and maintaining fitness of bodily tissue and organs or healing, strengthening, promoting growth of bone tissue comprising:

a. providing a therapeutic device comprising an exercise device that includes means for developing or maintaining fitness of bodily tissue or organs with a frame having at least one support surface for supporting an individual and that includes a rotary vibrational loading means associated with the support surface; and b. vibrating the at least one support surface with the rotary vibrational loading means at a selected load and frequency to induce mechanical vibration sufficient to facilitate bone growth or healing of bodily tissue, wherein the vibrational loading means displaces the bodily tissue up to 2 millimeters peak-to-peak.

32. The method of claim 31, wherein vibrating the support surface comprises vibrating the bodily tissue at a frequency ranging from about 10 Hz to about 100 Hz.

33. The method of claim 31, wherein the displacement caused by the vibrational loading means is sinusoidal.

* * * * *